US011400497B2

(12) United States Patent
Peers et al.

(10) Patent No.: US 11,400,497 B2
(45) Date of Patent: Aug. 2, 2022

(54) FLEXIBLE COLD ROLLING MILL AND METHOD FOR CONVERTING THE SAME

(71) Applicant: Cockerill Maintenance & Ingenierie S.A., Seraing (BE)

(72) Inventors: Johan Peers, Liege (BE); Francois Dumortier, Liege (BE)

(73) Assignee: COCKERILL MAINTENANCE & INGENIERIE S.A., Seraing (BE)

( * ) Notice: Subject to any disclaimer, the term of this patent is extended or adjusted under 35 U.S.C. 154(b) by 0 days.

(21) Appl. No.: 17/295,085

(22) PCT Filed: Jun. 14, 2019

(86) PCT No.: PCT/EP2019/065764

§ 371 (c)(1),
(2) Date: May 19, 2021

(87) PCT Pub. No.: WO2020/104078

PCT Pub. Date: May 28, 2020

(65) Prior Publication Data

US 2021/0354181 A1 Nov. 18, 2021

(30) Foreign Application Priority Data

Nov. 23, 2018 (EP) ..... 18208131

(51) Int. Cl.
*B21B 1/22* (2006.01)

(52) U.S. Cl.
CPC ..... *B21B 1/22* (2013.01)

(58) Field of Classification Search
CPC .... B21B 1/30; B21B 1/32; B21B 1/36; B21B 31/06; B21B 31/08; B21B 31/10; B21B 2031/026
See application file for complete search history.

(56) References Cited

U.S. PATENT DOCUMENTS 3,592,035 A * 7/1971 Buccicone ..... B21B 41/08 226/88
3,740,982 A * 6/1973 Hacker ..... B21B 37/28 72/12.2

(Continued)

FOREIGN PATENT DOCUMENTS

DE 3621612 A1 * 6/1986
DE 102006011937 A1 9/2007

(Continued)

*Primary Examiner* — Adam J Eiseman
*Assistant Examiner* — P Derek Pressley
(74) *Attorney, Agent, or Firm* — Leydig, Voit & Mayer, Ltd.

(57) ABSTRACT

A flexible conversion method of a reversible rolling mill having at least one rolling stand erected on first civil works foundations and a first production capacity, into an upgraded rolling mill having more than one rolling stand and a second production capacity, the second production capacity being higher than the first production capacity, the reversible rolling mill including: an uncoiling device or pay-off reel and a first recoiling device or entry tension reel on a first side or entry side of the stand; a second recoiling device or delivery tension reel on a second side or delivery side of the stand; standard auxiliary and operation equipment necessary for normal operation and control of the reversible rolling mill, the standard auxiliary and operation equipment necessary for normal operation and control of the reversible rolling mill including mainly or at least a roll coolant tank, pumps, filters, heat exchangers and piping.

13 Claims, 2 Drawing Sheets

(56) References Cited

U.S. PATENT DOCUMENTS

| | | | | | |
|---|---|---|---|---|---|
| 4,138,074 | A * | 2/1979 | Ross | B21C 47/3433 | 242/532.7 |
| 5,666,843 | A * | 9/1997 | Muller | B21B 35/02 | 72/234 |
| 5,706,690 | A * | 1/1998 | Connolly | B21B 1/36 | 72/229 |
| 5,746,081 | A * | 5/1998 | Klamma | B21B 1/36 | 72/239 |
| 2005/0285316 | A1 | 12/2005 | Kirstein et al. | | |
| 2007/0261457 | A1 * | 11/2007 | Witschas | B21B 31/00 | 72/239 |

FOREIGN PATENT DOCUMENTS

| | | | | |
|---|---|---|---|---|
| EP | 0265975 | A1 * | 10/1987 | |
| EP | 0265975 | A1 * | 5/1988 | B21B 31/06 |
| EP | 2500114 | A1 * | 9/2012 | B21B 1/36 |
| JP | H09216009 | * | 8/1997 | |
| WO | WO 2004054730 | A1 | 7/2004 | |
| WO | WO 2016055972 | A1 | 4/2016 | |

* cited by examiner

FLEXIBLE COLD ROLLING MILL AND METHOD FOR CONVERTING THE SAME

CROSS-REFERENCE TO PRIOR APPLICATIONS

This application is a U.S. National Phase application under 35 U.S.C. § 371 of International Application No. PCT/EP2019/065764, filed on Jun. 14, 2019, and claims benefit to European Patent Application No. EP 18208131.5, filed on Nov. 23, 2018. The International Application was published in English on May 28, 2020 as WO 2020/104078 under PCT Article 21(2).

FIELD

The present invention relates to the field of cold rolling mills and strip processing lines, in particular to flexible cold rolling mills as new solutions for enhancing competitiveness. More specifically, the present invention relates to the technological conversion of a twin stand reversing mill, into a rolling mill having a larger production capacity (and a higher number of stands) such as a tandem mill, a modern rolling mill, which can be either a coil-to-coil mill or a continuous mill, where rolling is performed in one pass in several stands, typically from 2 to 8, and where reductions take place successively, or a PLTCM ("pickling line and tandem cold mill").

The invention also relates to the method for converting the flexible cold rolling mill.

BACKGROUND

In the recent years, while the global steel market shows a declining tendency and overcapacity, regional differences are observed and Asia, in particular Southeast Asia, is still an expanding market, even considerably in some countries. Thus steel producers and equipment suppliers are not only faced with quality, sustainability or digitalization challenges but also with an important need for flexibility.

In this context arises the question of upgrading mill equipment in function of the evolution of annual production. The most used cold rolling mills are the single stand reversing mill (RCM) with an annual production typically lower than 500,000 t, the two stand reversing mill (also called "twin mill") with an annual production typically lower than 900,000 t and the tandem mill (TCM) with an annual production greater than 1,000,000 t, as illustrated in FIG. 1. Generally, cold strip producers firstly invest in a single stand rolling mill. When their market grows and they want to increase their production, they have the opportunity to invest in a second single stand rolling mill. However, two single stand rolling mills are less effective and more expensive than a twin stand mill.

Indeed, the advantages of the twin stand mill are low investment costs (CAPEX) and low operative costs (OPEX) as compared to two single stands and tandem mill. The flexibility and the wide range of product mix are also an advantage.

There is therefore currently a strong need to be able to upgrade mill capacities, for example, to step up from a single stand rolling mill into a twin stand mill or from a twin stand mill into a tandem mill. Flexibility of the equipment is the basis for the option to adapt to future market requirements.

Document "*Cold rolling Mills by SMS group—flexible plant concepts tailored to the demand of emerging markets*" by T. SEEGER and F. TÖPFER, 2018 SEAISI (http://www.seaisi.org/file/2018%20Conference%20Brochure(1).pdf) Conference & Exhibition, Jakarta, Indonesia, June 2018, comes to the same topic, that is to offer flexible equipment in the field of rolling mills. Upgrading flexibility requires that the design of single stand reversing mills and two stand mills be compatible in order to easily turning a RCM into a two stand mill. Among the proposed solutions to upgrade a single stand reversing cold mill into a two stand reversing cold mill is reduction of the civil works thanks to a very compact mill and foundation design prepared for a second stand, with an emulsion compact unit helping reducing cellar size besides its own advantages (reduction of piping efforts, and energy consumption). Similarly, the twin stand mill can also be converted into a TCM.

However, these transformations have the drawback to take a shutdown time of approximately two months until the mill starts operation again.

A conventional reversing cold rolling mill typically comprises mainly one or more stands (mill proper) as well as an unwinding machine called pay-off reel (POR), an entry winding machine called entry tension reel (ETR) and a delivery winding machine called delivery tension reel (DTR).

In operation, a coil is inserted into the POR, the head end is threaded into the DTR and put under tension, and specified reduction force is applied to the cylinders of the mill. Thereafter rolling of the first pass is carried out. The tension becomes lost when the coil tail is taken out of the POR, defining off-gauge length of strip. The latter can be reduced or minimized for example by continuing to apply tension thanks to a friction force using a strip press. The second pass (reversed) can then be started, the tail end of the strip being threaded into the ETR and the process continues as in the first pass. Rolling is repeated a number of times until the final thickness gauge of the product is attained. The number of rolling passes can be even (2, 4, 6, etc.) or odd (1, 3, 5, etc.).

A portion that is not rolled (off-gauge portion) remains at each end of the product coil (length of strip head between the mill and the DTR when threading the strip to the DTR and at most length of strip tail between the mill and the POR). The off-gauge length on the outer part of the coil can be cut out by means of a shearing machine usually located on the delivery side and is taken from the ETR or DTR (depending on the number of passes) as a small coil called pup coil to be disposed. The off-gauge portion in the inner of the product coil should be disposed in the following line or by an end user. Some techniques are known in the art to reduce these unrolled portions in order to improve productivity (see *New rolling method of reversing cold rolling mill*, Y. Kannaka et al., JP Steel Plantech, METEC 2015, Dusseldorf, Germany).

Document U.S. Pat. No. 5,706,690 A discloses a cold rolling mill and a method for cold rolling. The cold rolling mill includes at least two tandem four-high reversing mills with at least one tension reel on each side of the tandem mills.

Document WO 2016/055972 A1 relates to a combined pickling and rolling installation. The rolling mill comprises two winding reels and two mill stands, Another rolling mill stand can be placed upstream of the aforementioned stands (this extra rolling mill being erected at the same time as the two first mill stands), and configured to be open during the odd rolling step and closed during the even rolling step. In this way, two rolling steps are performed with a total of 5 (2+3) thickness reductions. Furthermore, the rollers of this additional stand may be provided with roughness greater than that of the other stands in order to provide a rolling surface with controlled roughness during the last rolling step.

SUMMARY

In an embodiment, the present invention provides a flexible conversion method of a reversible rolling mill having at least one rolling stand erected on first civil works foundations and a first production capacity, into an upgraded rolling mill having more than one rolling stand and a second production capacity, the second production capacity being higher than the first production capacity, the reversible rolling mill further comprising: an uncoiling device or pay-off reel and a first recoiling device or entry tension reel on a first side or entry side of the stand; a second recoiling device or delivery tension reel on a second side or delivery side of the stand; standard auxiliary and operation equipment necessary for normal operation and control of the reversible rolling mill, the standard auxiliary and operation equipment necessary for normal operation and control of the reversible rolling mill comprising mainly or at least a roll coolant tank, pumps, filters, heat exchangers and piping to the stands, electrics and automation systems, a hydraulic power pack and valves, gearboxes, a gearbox lubrication system, spot welding machines, shearing machines, roll change cars, threading equipment, belt wrappers and coil extraction machines, the upgraded rolling mill being obtained at an end of the conversion by providing to the upgraded rolling mill an exclusive delivery side corresponding to the entry side of the former reversible rolling mill and an entry side located on the same side as the delivery side of the former reversible rolling mill, the entry tension reel becoming after conversion a delivery tension reel only, so that the rolling operation is done in one pass only and the rolling mill is not reversible anymore, the method comprising the following steps executed in shadow time during normal operation of the reversible rolling mill having at least one rolling stand if required, placing a protection and/or separation between the operated reversible rolling mill on the side of the second recoiling device and an assembly area, in order to protect an assembly team; providing new second civil works foundations or utilizing already existing, and/or already built with the reversible rolling mill and unused second civil works foundations specifically for installing at least one additional rolling stand or, all in all, to have at the end at least two rolling stands; installing the at least one additional rolling stand; and extending existing standard auxiliary and operation equipment or installing additional standard auxiliary and operation equipment necessary for proper operation and control of the whole upgraded rolling mill, and performing at least partial check-up and/or cold commissioning of the equipment.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
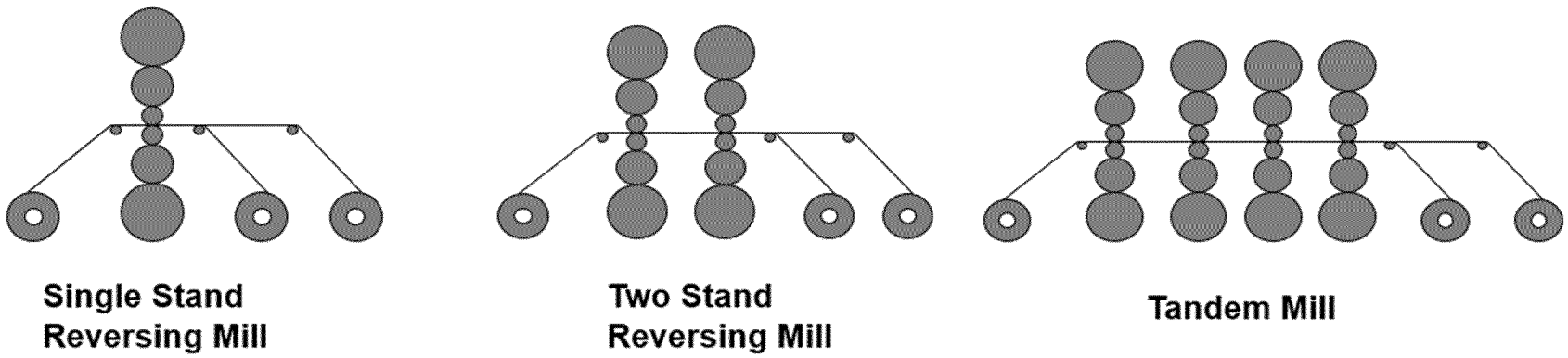
FIG. 1 schematically represents a comparison of a single stand reversing mill, a two stand reversing mill and a tandem mill respectively.

In an embodiment, the present invention overcomes the drawbacks of prior art in case of a cold rolling mill upgrading.

In particular, the present invention aims to provide a flexible cold rolling mill with easy adaptation for auxiliary equipment. More particularly, the present invention aims at flexibly converting/upgrading a rolling mill, for example a twin stand mill, into an upgraded mill, for example a PLTCM or a tandem mill, which is either a coil-to-coil mill or a continuous mill, in a manner which is simple and the cheapest possible.

A purpose of the present invention is to flexibly provide an upgraded rolling mill, which can be converted with reduced shutdown time, i.e. with reduced impact on normal production, in contrast with the prior art.

A first aspect of the present invention relates to a flexible conversion method of a reversible rolling mill having at least one rolling stand erected on first civil works foundations and a first production capacity, into an upgraded rolling mill having more than one rolling stand and a second production capacity, said second production capacity being higher than the first production capacity, said reversible rolling mill further comprising:

an uncoiling device or pay-off reel and a first recoiling device or entry tension reel on a first side or entry side of the stand;

a second recoiling device or delivery tension reel on a second side or delivery side of the stand;

standard auxiliary and operation equipment necessary for normal operation and control of the reversible rolling mill, said standard auxiliary and operation equipment necessary for normal operation and control of the reversible rolling mill comprising mainly or at least a roll coolant tank, pumps, filters, heat exchangers and piping to the stands, electrics and automation systems, a hydraulic power pack and valves, gearboxes, spot welding machines, shearing machines, roll change cars, threading equipment, belt wrappers and coil extraction machines;

characterised in that the upgraded rolling mill is obtained at the end of the conversion by providing to it an exclusive delivery side corresponding to the entry side of the former reversible rolling mill and an entry side located on the same side as the delivery side of the former reversible rolling mill, the entry tension reel becoming after conversion a delivery tension reel only, so that the rolling operation is done in one pass only and the rolling mill is not reversible anymore, and in that the conversion of the reversible rolling mill into the upgraded rolling comprises the following steps executed in shadow time, during normal operation of the reversible rolling mill having at least one rolling stand:

if required, placing a protection and/or separation between the operated reversible rolling mill on the side of the second recoiling device and an assembly area, in order to protect an assembly team;

providing in masked time new second civil works foundations or utilizing already existing, and/or already built with the reversible rolling mill (1) and unused second civil works foundations for installing the at least one additional rolling stand or, all in all, to have at the end at least two rolling stands, the second civil works foundations of said at least one additional rolling stand being thereupon specifically provided for the conversion of the reversible rolling mill into the upgraded rolling mill;

installing at least one additional rolling stand;

extending standard auxiliary and operation equipment or installing additional standard auxiliary and operation equipment necessary for proper operation and control of the whole upgraded rolling mill on the protected assembly area, and performing at least partial check-up and/or cold commissioning of the equipment.

According to preferred embodiments of the invention, the flexible conversion method also comprises one or a suitable combination of the following characteristics:

it comprises the further steps of:

shutting down the operated reversible rolling mill and removing said protection/separation, if installed;

removing the pay-off reel and possibly displacing it at a distal end of the line, opposite to the first recoiling device;

removing the second recoiling device and possibly displacing it at the previous location of the pay-off reel, to become a second recoiling device in the upgraded rolling mill;

connecting stands together by providing a transfer means disposed above a spacing, so that the rolling stand is proximal to a first end of the spacing and the additional rolling stand is proximal to a second end of the spacing, for assuring future continuous rolling in the upgraded rolling mill, in the vicinity of the location where the second recoiling device was at the time the reversible rolling mill was in operation;

connecting said additional standard auxiliary and operation equipment necessary for proper operation and control of the whole upgraded rolling mill with said standard auxiliary and operation equipment necessary for normal operation and control of the reversible rolling mill, harmonizing the same and achieving final check-up of the whole equipment;

performing normal operation of the upgraded rolling mill.

it further comprises the step of providing said spacing defined as the spacing located between an edge of the first civil works foundations related to the initial reversible rolling mill and a contiguous edge of the second civil works foundations provided for installing said at least one additional rolling stand, so that to allow a continuity of the rolling between said at least one rolling stand and said at least one additional rolling stand in the future upgraded rolling mill thanks to the placing of the transfer means disposed between the rolling stand proximal to a first end of the spacing and the additional rolling stand proximal to a second end of the spacing;

it comprises the step of providing a transfer means selected from the group consisting of a simple table, a rolling table, an air-cushion table, a sliding guide table, magnetic means and any other device used to support or thread the strip above the spacing;

it comprises the step of providing a spacing having a length in the range of 7-20 meters;

it comprises the step of providing a spacing having a length of about 10 meters;

it comprises the step of providing a spacing having a length comprised between 1.5 and 3 times a given width (L) of the civil works foundations associated to an individual stand;

it is coupled with a reversible rolling mill having an even-number of rolling passes strategy, that is a rolling method wherein a rolling normally carried out in N passes (N integer, odd) with a given reduction rate is replaced by a rolling in N+1 passes (N+1 integer, even) having in all the same reduction rate.

Other aspects of the invention relate to the above-mentioned method used:

for flexibly upgrading a two rolling stands reversible rolling mill into an upgraded rolling mill having three stands or more;

for flexibly upgrading a single stand reversible rolling mill into an upgraded rolling mill having two stands or more;

for flexibly upgrading a single stand reversible rolling mill into an upgraded rolling mill having three or four stands;

for flexibly upgrading a reversible twin rolling mill into a tandem mill or a PLTCM.

Still another aspect of the present invention relates to an upgraded rolling mill resulting from the flexible conversion of the reversible rolling mill obtained by carrying out the method described above.

Figure 2:
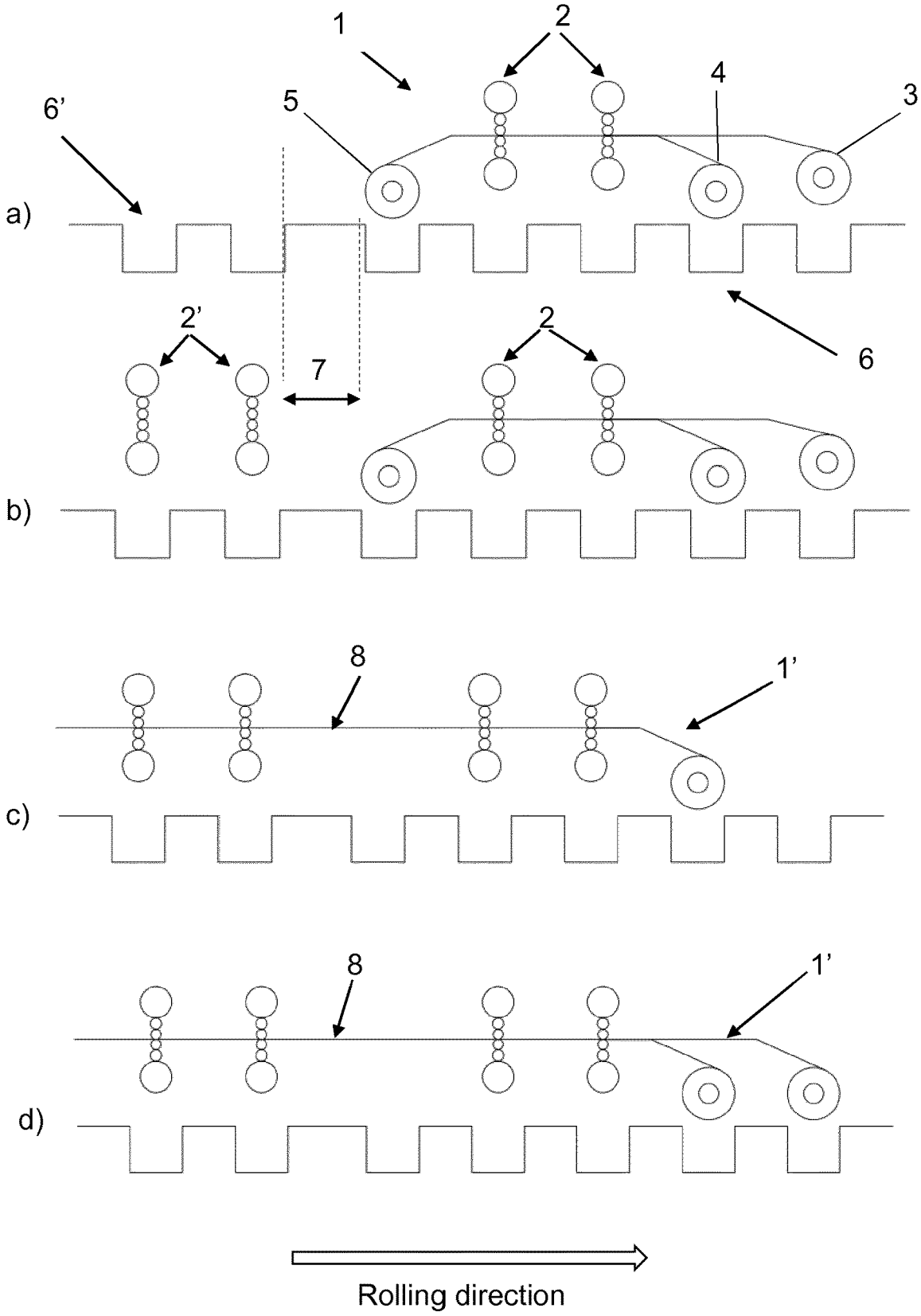
FIG. 2 schematically represents an embodiment showing four steps (a-d) of a method for converting a two stand rolling mill into a tandem rolling mill or a PLTCM, according to the present invention.

The present invention starts from the general design for a cold rolling mill 1, as depicted in FIG. 2, comprising at least two rolling stands 2. The rolling mill 1 further comprises an uncoiling device also called pay-off reel (POR) 3, a first recoiling device also called entry tension reel (ETR) 4 and a second recoiling device also called delivery tension reel (DTR) 5. According to the invention, the civil works 6, 6' for the foundations of the rolling mill are designed and realized so as to be ready for a future extension, namely for the adding of one or more stands. For example, the civil works for an upgraded twin rolling mill comprises the location for at least three rolling stands in the final configuration.

According to the invention, a spacing 7 is provided between the initial mill 1 having rolling stands 2 and the civil works 6' provided for the rolling stands in view of the future extension. In order to clarify the explanations of the present disclosure, "phase I" is specified in reference to the rolling stands comprised in the rolling mill as originally built, and "phase II" is specified in reference to the additional rolling stands of the future extension of the rolling mill.

Thanks to spacing 7 provided between the existing rolling stands 2 of phase I and the new rolling stands 2' provided in phase II, the installation of additional stands 2' of phase II can be realized in shadow time (or masked time or hidden time), that is while the production in the initial mill is still normally running. It is therefore not necessary to shut down the line of the rolling mills 2 of phase I for the mounting of phase II stands 2' and related auxiliary equipment. The development and the extension of the rolling mill will henceforth have a lower impact on production than in prior art, because the additional stands will be erected during the production. Advantageously, the length of spacing 7 is comprised in the range of 7-20 meters, preferably is of the order of 10 meters. Any other distance different from those mentioned above is possible if necessary.

In an alternate embodiment, the civil works foundations 6' for the additional stands 2' can also be realized between phase I and phase II (in masked time).

During the inevitable shutdown, which is however considerably reduced in comparison of prior art, DTR 5 is removed (step b)) The stands of phase I and II are connected together, and a transfer means 8 is placed between the two pairs of stands 2, 2' in the place, where DTR 5 was located during phase I, in order to link the rolling stands together. It is noticed that in this location the civil works (cellar foundation) are not used anymore in phase II. In the example shown on FIG. 2, the uncoiling device (POR 3) is also removed (step c)), and the spacing left in the foundation by the former uncoiling device can be used in the future to install the removed DRT, which will be used as a second recoiling device (case d)).

Additionally, the present invention is advantageously compatible with a rolling mill built in phase I having an even-number of passes strategy. In this case, for products usually rolled in one pass, two passes are made with less reduction at each pass (same total reduction). The same principle applies with 4 passes instead of 3 passes, 6 passes instead of 5 passes, etc.

Moreover, a method of rolling and the rolling mill for carrying out the method (such as a twin mill), including the above-mentioned even-number of passes strategy can be considered as a separate invention.

The present invention, in combination with an even-number of passes strategy in phase I has a number of advantages:

Less equipment is required, as the exit of the product is always at the same location (on the entry side). Simplified equipment is required at the so-called delivery side (DTR) only for remedying possible troubleshooting, while only one shape measurement device (called shapemeter) and one selective spraying device (called selective cooling) are necessary. This represents for example approximately 4-5% of the sale price of the two stand mill. That means thus less maintenance and less investment cost (CAPEX);

More productivity (e.g. gain up to 3%) as the next coil is started earlier because the winding is effected at the ETR and the DTR is available for new threading and winding (without waiting for the removal of the previous coil);

Optimizing roll roughness (i.e. different roughness at different stands): higher roughness at stand 1 helps for threading and final roughness transfer at last pass (as last reduction is always at stand 1), while lower roughness at stand 2 provides better reduction capability;

Operational practice is easier as exit side is always the same;

Different gear ratios for stands 1 and 2 allow more torque and thus more reduction at stand 1 and render the pre-mill suitable for future upgrade (to tandem mill or PLTCM);

As productivity is higher with an even pass strategy, time saving (compared to conventional strategy with even/odd passes) can be used to completely roll the strip, even with four passes or more, leading to less off gauge (or less out of thickness tolerance) and thus no need for pup coil disposal;

Possible use of two different oil concentrations (low concentration on stand 1 and high concentration on stand 2), in order to have clean coils for batch annealing;

More than 95% of the product mix is usually covered by 2 or 4 passes.

Some of the above advantages are common with the above-mentioned separate invention, thus while using the rolling mill of phase I (stands with different roughness, oil concentrations, gear ratios/torques, etc.).

The general advantages of the invention are the following:

Possible evolution to the tandem mill: the client which does not want to directly invest in a tandem mill (about 25-30 M€) can start with a two stand mill (about 14 M€). At the time of the expansion, the client converts the twin mill into a tandem mill instead of buying a new reversing mill;

Reduction of the upgrading shutdown time from 2 months to less than 2 weeks.

In WO2016/055972 A1, the possibility of providing another rolling stand is not at all similar to upgrading a rolling mill by providing an additional stand as in the present invention. No foundation was planned upstream of the two first stands, and the three stands were erected at the same time, together with the foundations thereof. In addition, no space is provided between the stands to allow the construction of the new additional stand without hindering the production of existing stands.

Example: Two Stand Mill Converted to Continuous Tandem Mill or PLTCM

The rolling mill 1 is designed as a twin mill with provision for additional stands. As the entry side of rolling mill 1 will become the exit side of the upgraded mill 1', the stands of rolling mill 1 are named stand #3 and stand #4. Thanks to providing high tension before stand #1 of the new additional stands 2', usually only four stands in PLTCM are necessary (but it could be only three also), compared to 5 stands in batch mill (but more than 4 stands may be necessary in specific cases). Roll coolant tank is provided with capacity for four stands. Foundations are made ready for Phase II. At this time, suitable protection/separation is provided to protect the assembly company team during production of the two stand mill. The following auxiliary equipment is added: one hydraulic power pack and valve stands for loading and bending system for stands #1 and #2, similar as in the already installed equipment, roll coolant pumps, filters, heat exchangers, etc., electrics for stands #1 and #2, as well as similar lubrication systems for the new gearboxes. There is no need of additional clean emulsion tank for stand #4, as degreasing capacity is dimensioned for reversing operation in phase I.

New stands #1 and #2 and piping are also installed during production. Motors and gearbox of stands #1 and #2, as well as cabling and electrical works are installed. Gearbox of stand #3 and #4 are already at the good location. Motor power of stands is already foreseen for PLTCM operation. Equipment (bridles, etc.) for coupling to pickling line are installed and finally cold commissioning of the stands production is done.

During main shutdown the following operations are performed:

removing of DTR and installation of transfer means(s);

old POR position becomes space provision for a second recoiler;

(former) stand 1 of phase I becomes stand #4, without any mechanical or electrical change;

(former) stand 2 of phase I becomes stand #3, without any mechanical or electrical change;

modification of automation system for PLTCM operation.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SYMBOLS

1 initial cold reversible rolling mill
1' upgraded cold rolling mill
2 rolling stands (phase I)
2' rolling stands (phase II)
3 pay-off reel (POR)
4 entry tension reel (ETR)
5 delivery tension reel (DTR)
6 civil works of initial stand(s)
6' civil works of new stand(s) in the upgraded mill
7 Spacing
8 transfer means(s) such as a rolling table

The invention claimed is:

1. A flexible method of converting a reversible rolling mill having at least one rolling stand erected on first civil works foundations with a first production capacity into an upgraded rolling mill having more than one rolling stand with a second production capacity higher than the first production capacity, the method comprising:

providing a reversible rolling mill comprising:

at least one previously existing rolling stand erected on a first civil works;

an uncoiling device or pay-off reel and a first recoiling device or entry tension reel on a first side or entry side of a previously existing rolling stand;

a second recoiling device or delivery tension reel on a second side or delivery side of a previously existing rolling stand; and operation equipment for operation and control of the reversible rolling mill, the operation equipment comprising a roll coolant tank, pumps, filters, heat exchangers and piping to the previously existing stand, electrics and automation systems, a hydraulic power pack and valves, gearboxes, a gearbox lubrication system, spot welding machines, shearing machines, roll change cars, threading equipment, belt wrappers and coil extraction machines;

in shadow time during operation of the reversible rolling mill:

providing new second civil works foundations, or utilizing already existing unused second civil works foundations, the second civil works foundations being located in line with the reversible rolling mill next to the delivery side of a previously existing rolling stand and specifically configured for installing at least one additional rolling stand;

installing at least one additional rolling stand on the second civil works foundations;

providing an exclusive delivery side corresponding to the entry side of a previously existing rolling stand;

providing an exclusive entry side located on a same side as the delivery side of a previously existing rolling stand, the entry tension reel becoming a delivery tension reel only so that the rolling operation is done in one pass only and the rolling mill is not reversible, extending existing operation equipment to the additional rolling stand or installing additional operation equipment for operation and control of the previously existing rolling stand and the additional rolling stands to obtain the upgraded rolling mill, and performing at least partial check-up and/or cold commissioning of the operation equipment.

2. The method of claim 1, further comprising:

shutting down the reversible rolling mill;

removing the pay-off reel and displacing the pay-off reel at a distal end of the line, opposite the first recoiling device;

removing the second recoiling device and displacing the second recoiling device at a previous location of the pay-off reel, to become a second recoiling device in the upgraded rolling mill;

connecting stands together by providing a transfer means disposed above a spacing, so that the rolling stand is proximal to a first end of the spacing and the additional rolling stand is proximal to a second end of the spacing, for assuring future continuous rolling in the upgraded rolling mill, in a location where the second recoiling device was at the time the reversible rolling mill was in operation;

connecting the additional operation equipment for operation and control of the upgraded rolling mill with the operation equipment for operation and control of the reversible rolling mill, harmonizing the same, and achieving final check-up of the whole operation equipment; and performing operation of the upgraded rolling mill.

3. The method according to claim 2, further comprising:

providing the spacing defined as the spacing located between an edge of the first civil works foundations related to the initial reversible rolling mill and a contiguous edge of the second civil works foundations provided for installing the at least one additional rolling stand, so as to allow a continuity of the rolling between the at least one rolling stand and the at least one additional rolling stand in the future upgraded rolling mill due to a placing of the transfer means disposed between the rolling stand proximal to a first end of the spacing and the additional rolling stand proximal to a second end of the spacing.

4. The method according to claim 3, further comprising:

providing a transfer means selected from the group consisting of a simple table, a rolling table, an air-cushion table, a sliding guide table, magnetic means, and any other device used to support or thread the strip above the spacing.

5. The method according to claim 3, further comprising:

providing a spacing having a length in the range of 7-20 meters.

6. The method according to claim 5, further comprising:

providing a spacing having a length of about 10 meters.

7. The method according to claim 3, further comprising:

providing a spacing having a length comprised between 1.5 and 3 times a given width of the civil works foundations associated to an individual stand.

8. The method according to claim 1, wherein the method is used to flexibly upgrade a two rolling stands reversible rolling mill into an upgraded rolling mill having three stands or more.

9. The method according to claim 1, wherein the method is used to flexibly upgrade a single stand reversible rolling mill into an upgraded rolling mill having two stands or more.

10. The method according to claim 9, wherein the method is used to flexibly upgrade a single stand reversible rolling mill into an upgraded rolling mill having three or four stands.

11. The method according to claim 1, wherein the method is used to flexibly upgrade a reversible twin rolling mill into a tandem mill or a PLTCM.

12. The flexible conversion method of a reversible rolling mill into an upgraded rolling mill according to claim 1, wherein the reversible rolling mill is run with an even-number of rolling passes strategy, that is a rolling method wherein a rolling normally carried out in N passes (N integer, odd) with a given reduction rate is replaced by a rolling in N+1 passes (N+1 integer, even) having in all the same reduction rate.

13. The method according to claim 1, further comprising:

placing a protection and/or separation between the reversible rolling mill on a side of the second recoiling device and an assembly area, in order to protect an assembly team.

* * * * *